United States Patent [19]

Sado et al.

[11] Patent Number: 4,458,243

[45] Date of Patent: Jul. 3, 1984

[54] ELECTRONIC DEVICE FOR DISPLAYING ACCENTS

[75] Inventors: Ichiro Sado, Juji Kishimoto, both of Tokyo, Japan

[73] Assignee: Canon Kabushiki Kaisha, Tokyo, Japan

[21] Appl. No.: 366,577

[22] Filed: Apr. 8, 1982

Related U.S. Application Data

[63] Continuation of Ser. No. 145,005, Apr. 29, 1980.

[30] Foreign Application Priority Data

May 8, 1979 [JP] Japan ..... 54-55269

[51] Int. Cl.[3] ..... G09G 3/04

[52] U.S. Cl. ..... 340/756; 340/790

[58] Field of Search ..... 340/756, 765, 790

[56] References Cited

U.S. PATENT DOCUMENTS 3,505,672 4/1970 Chisholm ..... 340/758 X
3,925,977 12/1975 Maezawa ..... 340/756 X
4,117,542 9/1978 Klausner et al. ..... 364/200
4,124,843 11/1978 Bramson et al. ..... 340/711
4,163,230 7/1979 Konii ..... 340/765
4,323,893 4/1982 Ypsilantis et al. ..... 340/756

*Primary Examiner*—David L. Trafton
*Attorney, Agent, or Firm*—Fitzpatrick, Cella, Harper & Scinto

[57] ABSTRACT

An electronic device for displaying accent is disclosed which is useful for displaying words and sentences by use of a multiple-digit display device. In the respective word display parts of the multiple-digit display device, additional symbols for an accent display are provided. Alphabet characters can be expressed as five-bit codes. In one disclosed embodiment, an additional sixth bit is used to indicate the presence or absence of an accent associated with the character represented by the remaining five bits. In another disclosed embodiment, accented vowels are each represented by five-bit codes that are different from the five-bit codes representing the same vowels without accents, so that no sixth bit is necessary. Words are displayed while discriminating a word with accent from a word with no accent.

11 Claims, 5 Drawing Figures

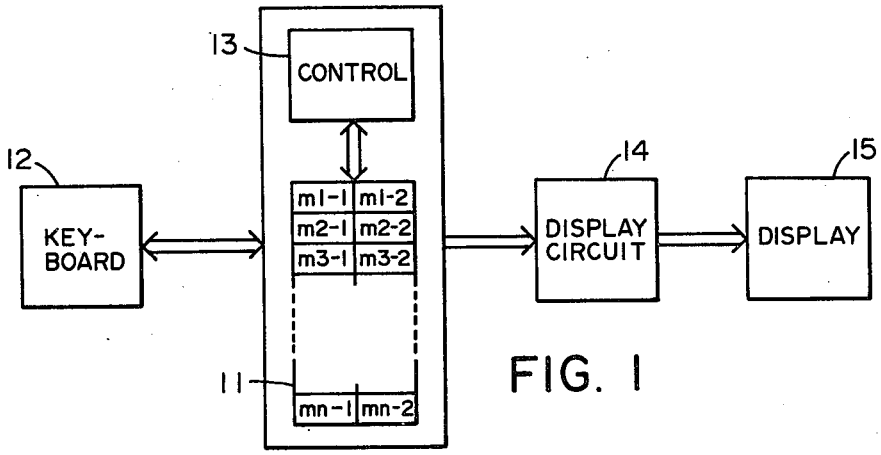
FIG. 1
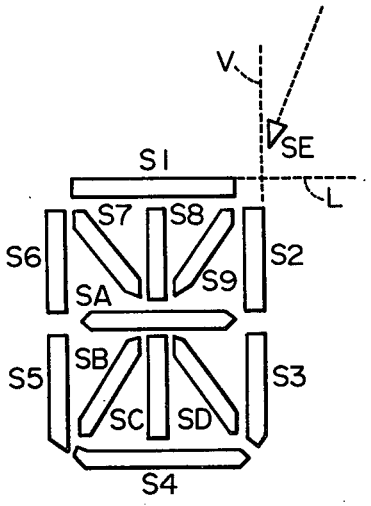
FIG. 2
| ALPHABET | BINARY CODE | HEXA-DECIMAL CODE | EXAMPLE OF DISPLAY |
|---|---|---|---|
| SPACE | 0 0 0 0 0 | 0 0 | |
| A | 0 0 0 0 1 | 0 1 | A |
| B | 0 0 0 1 0 | 0 2 | B |
| C | 0 0 0 1 1 | 0 3 | C |
| D | 0 0 1 0 0 | 0 4 | D |
| E | 0 0 1 0 1 | 0 5 | E |
| F | 0 0 0 1 0 | 0 6 | F |
| G | 0 0 1 1 1 | 0 7 | G |
| H | 0 1 0 0 0 | 0 8 | H |
| I | 0 1 0 0 1 | 0 9 | I |
| J | 0 1 0 1 0 | 0 A | J |
| K | 0 1 0 1 1 | 0 B | K |
| L | 0 1 1 0 0 | 0 C | L |
| M | 0 1 1 0 1 | 0 D | M |
| N | 0 1 1 1 0 | 0 E | N |
| O | 0 1 1 1 1 | 0 F | O |
| P | 1 0 0 0 0 | 1 0 | P |
| Q | 1 0 0 0 1 | 1 1 | Q |
| R | 1 0 0 1 0 | 1 2 | R |
| S | 1 0 0 1 1 | 1 3 | S |
| T | 1 0 1 0 0 | 1 4 | T |
| U | 1 0 1 0 1 | 1 5 | U |
| V | 1 0 1 1 0 | 1 6 | V |
| W | 1 0 1 1 1 | 1 7 | W |
| X | 1 1 0 0 0 | 1 8 | X |
| Y | 1 1 0 0 1 | 1 9 | Y |
| Z | 1 1 0 1 0 | 1 A | Z |
| A' | 1 1 0 1 1 | 1 B | Ä |
| I' | 1 1 1 0 0 | 1 C | Ï |
| U' | 1 1 1 0 1 | 1 D | Ü |
| E' | 1 1 1 1 0 | 1 E | Ë |
| O' | 1 1 1 1 1 | 1 F | Ö |
FIG. 3

ELECTRONIC DEVICE FOR DISPLAYING ACCENTS

This is a continuation of application Ser. No. 145,005, filed Apr. 29, 1980.

BACKGROUND OF THE INVENTION

1. Field of the Invention

The present invention relates to an electronic device for displaying words, sentences or the like in English, German and other languages. More particularly, the present invention relates to such electronic display device capable of also displaying the accent of the word, sentence or the like to be displayed.

2. Description of the Prior Art

With the rapid development of technology relating to integrated circuits in recent years it has become possible to obtain IC memories of large capacity and to store a set of data containing a first subset of information and a second subset of information related to the first subset. From the stored data the second subset of information can be put out as desired using a display device such as LED by putting in the first subset of information. An example of this novel technique is disclosed in U.S. Pat. No. 4,117,542. According to the technique disclosed in the patent specification, a name may be stored as the first subset of information and a street address and telephone number may be stored as the second subset of information. By making an input of the name, an output indicating the street address and telephone number can be obtained.

This technique will allow many applications of the electronic device. One example is an electronic interpreter. For example, the spelling of an English word and a Japanese or Germans translation thereof can be stored in a read-only memory (hereinafter referred to as ROM). When the spelling of the English word is put in from the keyboard, its Japanese or German translation can be displayed. Of course, such an electronic interpreter may be designed to display an English translation of a Japanese or German word by making an input of the Japanese or German word from the keyboard. Another application of this technique that is also known provides not only a display of the spelling of an input English word but also of the pronounciation of the input word.

In for practicing this technique, if the position of an accent can be displayed together with the spelling of an English word, the practical usefulness of the electronic device will be improved.

SUMMARY OF THE INVENTION

Accordingly, it is an object of the invention to provide an electronic device which is able to provide an output of a word or sentence also with an accent display.

It is another object of the invention to provide such electronic device for displaying an accent which is able to provide a display of the output of a word or the like while adding an accent adjacent the appropriate letter or letters of the output word.

It is a further object of the invention to provide such an electronic accent display device wich is able to clearly and distinctly display the accent.

Other and further objects, features and advantages of the invention will appear more fully from the following description taken in connection with the accompanying drawings.

BRIEF DESCRIPTION OF THE DRAWINGS

FIG. 1 is a block diagram of an electronic device incorporating the present invention;

FIG. 2 is a front view of a display device illustrating the structure of this device as used in the invention;

FIG. 3 is a table of the alphabet, and corresponding coded signals and modes of display;

DESCRIPTION OF THE PREFERRED EMBODIMENTS

Figure 4:
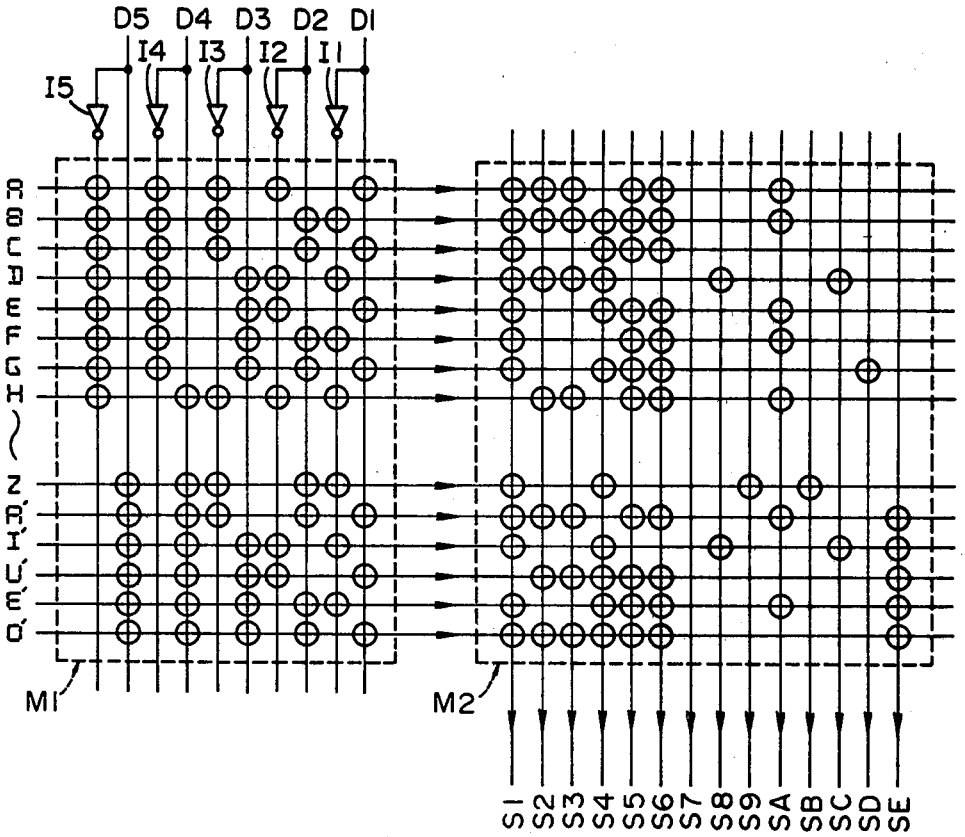
FIG. 4 shows a driver circuit for selecting and actuating the segments of the display device by means of the coded signals.

In FIG. 1, the reference numeral 11 designates a ROM which contains a first subset of data (such as Japanese or German words) stored in its first memory area m1-1, m2-1, m3-1,m4-1, . . . ,mn-1 and second subset of data corresponding to the first subset of data (such as English words) stored in its secondary memory area m1-2, m2-2, m3-2, m4-2, . . . , mn-2. In the two memory areas m1-1, corresponds to m1-2, m2-1 to m2-2 and m3-1 to m3-2. In the same manner mn-1 corresponds to mn-2.

In the illustrated embodiment, the second subset of data also contains therein information relating to accents. For example, when a word "ODOROKI" in Japanese has been stored in m1-1, then the corresponding English word "ALARM" is been stored in m1-2, together with information for accent of the word ALARM.

A keyboard for input of letters, numbers or the like is indicated at 12. A control circuit is indicated at 13. The control circuit 13 determines whether or not the data put in by the keyboard has been stored in the first memory area of the ROM 11. When the input data has been stored, the corresponding second data can be displayed alone or together with the first input data on the display device 15 through a display circuit 14.

The relation between the input and output data may be reversed by changing the above arrangement. Namely, the arrangement may be modified to put out the first data when an input of the second data is made. Also, the device may be so formed as to put out only the second data successively by operating a step-by-step switch on the keyboard. In this way, the operator can check whether or not he has kept corresponding data in memory. Therefore, the operator can use this electronic device in this fashion as a dictionary or interpreter.

Since the arrangement of the electronic device generally described above is known in the art, for example, as disclosed in the above mentioned U.S. Pat. No. 4,117,542 with the exception of this particular type of data stored in the ROM, it will not be described further in detail.

The structure of the display device 14 used in the electronic apparatus according to the invention will be described in detail with reference to FIG. 2.

A pattern of display segments, arranged in the so-called "Union Jack" pattern, shown in FIG. 2 is provided for display of one alpha or numeric character. The pattern comprises 13 segments for display of such a character namely, S1, S2, . . . , S9, SA, SB, SC, SD (Union Jack pattern) and an additional segment SE for display of an accent, the number of segments being 14 in total. It should be understood that the illustrated arrangement of segments is only an example of many useful arrangements. The accent segment SE may be disposed differently from the above provided that the selected position is suitable for clearly indicating that the displayed character should be accentuated. In the illustrated embodiment, the accent segment SE is disposed to be inclined toward the Union Jack pattern and at a position adjacent yet spaced slightly rightwardly from the segments S2, S3 and adjacent yet spaced slightly upwardly from segment S1.

In practice, a multiple-digit display device includes a plurality of such 14 segment patterns to display every word in an alphabetical expression. In order to display 26 characters of alphabet in terms of binary code, usually at least 5 bits are required. In this case, if one code is allotted for a space (blank) between characters, then five codes will be available as remainder since the maximum number of codes expressible by 5 bits is 32. According to one embodiment of the invention, these remaining five codes are allotted for five vowels that are accentuated, that is, A, I, U, E and O displayed in the respective accentuated forms A', I',U', E' and O'.

FIG. 3 shows a code table of such alphabet characters that include the accentuated vowel characters in the form described above. In the code table, characters in alphabet to be displayed are given in the leftmost column and the characters as actually displayed in accordance with the pattern shown in FIG. 1 are given in the rightmost column. As for the vowels A, I, U, E and O, when any of them should be accentuated, the segment SE is put on to indicate each respectively in the form of A', I', U', E' or O'. In the two remaining columns of the table of FIG. 3 examples of codes useful in storing the data in the memory are given. One code is for binary code display and the other is for hexadecimal code display.

While separate codes have been shown as stored for accentuated vowels A', I', U', E', O' and for unaccentuated vowels, A, I, U, E, O, it should be understood that coding for accent display is not limited to the illustrated example only. For example, the following various coding methods may be used:

(1) A particular bit may be added for displaying the position of an accent for every word code as in the case of decimal point memory digit in operational processing by a table top or desk-top computer or calculator;

(2) A binary code of 26 alphabet characters using 5 bits may be used with one additional bit as accent bit. When the accent bit is set, it means that the character has an accent and when not set it means that the character has no accent. This information is also stored in the memory. According to this coding method, every character is expressed using 6 bits per character. This coding method enables expression of characters in katakana and therefore has an advantage as providing an electronic dictionary.

(3) Of course, separate codes can be assigned to accentuated vowels and to unaccentuated vowels as shown in the FIG. 3 table. Only 32 codes expressible by 5 bits, are used in this case. 26 codes for 26 alphabet characters, one for a space and five remaining codes for five accentuated vowels.

Among the three coding methods mentioned above, the method (3) is most preferred because it makes efficient use of memory. As previously mentioned, the code shown in FIG. 3 is an embodiment of the method (3). The memory described above contains data relating to characters and accentuated characters coded and stored according to the code shown in FIG. 3. The following table, Table 1 shows three examples of of hexadecimal coded alphabetical words. The code 1B for "A" of the word "ALARM" indicates that the "A" is to be accentuated.

TABLE 1

| Word | Hexadecimal code |
|---|---|
| ALA'RM | 01, 0D, 1B, 12, 0C |
| ALL | 01, 0C, 0C, 00, 00 |
| ALO'NE | 01, 0C, 1F, 0E, 05 |

FIG. 4 shows a matrix converter circuit (display circuit 14) used for putting on the segment display device shown in FIG. 2 by means of the codes shown in FIG. 3. In FIG. 4, D1 to D5 are signal lines connected to ROM 11 to transmit a 5 bit alphabet code read out from ROM. The 5 bit data are also supplied to inverters I1 to I5. Outputs from these inverters as well as outputs directly coming from the signal lines D1 to D5 without passing through the inverters are applied to the first matrix circuit M1. Each symbol ◯ used in the matrix circuit M1 stands for an AND gate. Each five ◯ symbols in each row are equivalent to a five-input AND gate all inputs to which must be enabled to produce an enabled output. This notation is an ordinary one for a matrix circuit and need not be further described. It will be understood that the first matrix circuit M1 includes a total of 32 in total of 5-input AND gates of which are 26 are for alphabet character, one is for a blank and 5 are for accentuated vowels. The 32 horizontal lines in the matrix circuit are output lines of the respective 5-input AND gates. Letters corresponding to each respective output are shown in the left side marginal of the drawing. For example, when D5, D4, D3, D2, D1 are respectively 00010 which is the code for "B", an output appears only at the horizontal signal line indicating B.

These horizontal signal lines are connected to the second matrix circuit M2. The second matrix circuit M2 is a set of OR circuits each having, as its input, one of the 32 horizontal signal lines corresponding to A, B, C, D, . . . , X, Y, Z, A', I', U', E' and O'. Gates indicated by symbol ◯ appearing in each vertical line are equivalent to a multiple input OR gate. The OR output of each the vertical line, a decoded output is applied to the corresponding segment of the display device, S1, S2, . . . or SE through a suitable buffer (not shown). For example, when an output appears on a signal line S1, then the correcponding segment S1 is put on to become visible.

In this manner, alphabet code D1–D5 is converted into a code for driving or actuating the display segments to yield an appropriate visible display. While in the above embodiment, the matrix M1 has been shown to be formed by AND circuits and the maxtrix M2 or by OR circuits, in practive both of the matrixes M1 and M2 are often formed using NAND circuits. It is well-known in the art that a combination of AND-OR circuits can be replaced by a combination of NAND-NAND circuits. From FIG. 4 it will be understood that letters A and A' are different from each other only in the output SE.

Figure 5:
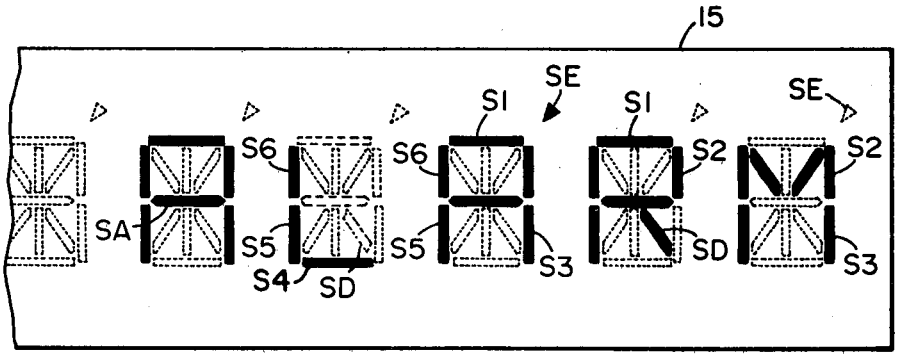
FIG. 5 is a front view of the display device with an English word being displayed thereon.

FIG. 5 shows an example of displays actually made on the display device 15 wherein an English word "ALARM" is put out. Since the word "ALARM" has previously been stored in ROM 11 together with an accent, the accent display segment SE appears at the right and upward side of the second "A" at the time of display. Thus, the operator can easily and clearly know where the accent is properly positioned for the illustrated word.

While the invention has been particularly shown and described with reference to a preferred embodiment thereof, it will be understood by those skilled in the art that the alternative embodmiments described generally above and other changes in form and details can be made without departing from the spirit and scope of the invention. For example, in place of the segment display shown in FIG. 2, a dot matrix display system or other suitable system may be used in the invention.

With the electronic device according to the invention, the position of an accent in a displayed word is distinctly shown, improving the effectiveness of the device for teaching or learning a language. Also, in the preferred embodiment, one alphabet character namely any one of the vowels can be represented either with or without an accent by using 5 bits. Therefore no increase in memory capacity is required to display an accent on any of the vowels and that accent display can be realized in a simple manner by modifying existing display devices and matrix circuits.

What we claim is:

1. An electronic device for displaying alphanumeric characters both with and without an accent comprising:

memory means for storing first code signals and second code signals, by using the minimum number of bits needed for encoding every one of a group of single characters into a different code signal, the first code signals being formed as different code signals produced by encoding the group of single characters and by using the minium number of bits, the second code signals being formed as different code signals that are different from the first code signals and are produced by encoding accentuated single characters included in the group of single characters;

display means including a plurality of single character display parts and an accent display part provided for each character display part and corresponding to the group of single characters; and driving means for actuating said single character display parts of said display means in response to the first code signals read out from said memory means and for actuating said single character display parts and the accent display part in response to the second code signals read out from said memory means.

2. An electronic device according to claim 1, wherein said driving means includes discrimination means for discriminating between the first code signals and the second code signals.

3. An electronic device according to claim 1, wherein each said accent display part is positioned to the right and upwardly adjacent one said character display part.

4. An electronic device according to claim 1, wherein said display means comprises segment display means, including a plurality of segments, for displaying characters by selectively actuating at least one of said segments.

5. An electronic device according to claim 1, wherein said driving means includes conversion means for converting the second code signals into an actuating signal for actuating at least one segment of said segment display means corresponding to the second code signals.

6. An electronic device for displaying alphabet characters both with and without an accent comprising:

memory means for storing first words formed by combination of a plurality of single characters, second words corresponding to the first words, and accent data for indicating accent position of the second words;

input means for introducing said first words to thereby read out the second words and the accent data corresponding to each said first word from said memory means;

display means including character display parts for displaying second words read out from said memory means and an accent display part associated with each of the character display parts; and driving means for actuating at least one character display part and at least one accent display part of said display means in response to at least one of the second words and accent data read out from said memory means in response to first words introduced by said input means.

7. An electronic device according to claim 6, wherein each said accent display part is positioned to the right and upwardly adjacent one said character display part.

8. An electronic device according to claim 6, wherein said display means comprises segment display means, including a plurality of segments, for displaying characters by selectively actuating at least one of said segments.

9. An electronic device for displaying alphanumeric characters both with and without an accent comprising:

memory means for storing first information and second information corresponding to said first information, said second information comprising code signals formed of different codes with a predetermined bit number produced by encoding each of a plurality of single characters, and an accent bit for indicating the presence and absence of accent provided with the code signals;

input means for entering said first information thereby to read out said second information from said memory means;

display means including a plurality of character display parts and an accent display part corresponding to each character display part for displaying the second information which is read out from said memory means in response to first information entered by said input means; and driving means for actuating the character display parts of said display means in response to the second information and an accent display part read out from said memory means.

10. An electronic device according to claim 9, wherein each said accent display part is positioned to the right and upwardly adjacent one said character display part.

11. An electronic device according to claim 9, wherein said display means comprises segment display means including a plurality of segments for displaying characters by selectively actuating at least one of said segments.

* * * * *

UNITED STATES PATENT AND TRADEMARK OFFICE

CERTIFICATE OF CORRECTION

PATENT NO. : 4,458,243

DATED : July 3, 1984

INVENTOR(S) : ICHIRO SADO, ET AL.

It is certified that error appears in the above-identified patent and that said Letters Patent is hereby corrected as shown below:

Column 1

Line 37, change "Germans" to --German--,

Line 47, change "pronounciation" to --pronunciation--,

Line 49, insert --electronic devices-- after "In".

Column 2

Line 32, delete "been".

Column 3

Line 56, change "as" to --of--.

Column 4

Line 3, change "of", second occurrence, to --such--.

Line 10, change "OD" to --OC--,

Line 30, delete "in total of",

Line 35, change "marginal" to --margin--,

Line 46, delete "the",

UNITED STATES PATENT AND TRADEMARK OFFICE

CERTIFICATE OF CORRECTION

PATENT NO. : 4,458,243

DATED : July 3, 1984

INVENTOR(S) : ICHIRO SADO, ET AL.

It is certified that error appears in the above-identified patent and that said Letters Patent is hereby corrected as shown below:

Column 4 (Continued)

Line 56, delete "or", first occurrence, following "M2".

Line 57, change "practive" to --practice--.

Signed and Sealed this

*Twelfth* Day of *March 1985*

[SEAL]

*Attest:*

DONALD J. QUIGG

*Attesting Officer* *Acting Commissioner of Patents and Trademarks*